US006257112B1

(12) United States Patent
Wakabayashi et al.

(10) Patent No.: US 6,257,112 B1
(45) Date of Patent: Jul. 10, 2001

(54) APPARATUS FOR MANUFACTURING PHOTOGRAPHIC FILMSTRIPS

(75) Inventors: Akira Wakabayashi; Takayuki Kambara, both of Kanagawa (JP)

(73) Assignee: Fuji Photo Film Co., Ltd., Kangawa (JP)

( * ) Notice: Subject to any disclaimer, the term of this patent is extended or adjusted under 35 U.S.C. 154(b) by 0 days.

(21) Appl. No.: 09/404,593

(22) Filed: Sep. 24, 1999

Related U.S. Application Data

(62) Division of application No. 08/839,773, filed on Apr. 15, 1997, now Pat. No. 6,003,420.

(30) Foreign Application Priority Data

Apr. 26, 1994 (JP) ..... 6-88817
Jun. 24, 1994 (JP) ..... 6-143320

(51) Int. Cl.[7] ..... B26D 5/20

(52) U.S. Cl. ..... 83/214; 83/263; 83/687; 83/948; 83/236

(58) Field of Search ..... 83/76.9, 214, 236, 83/241, 263, 620, 687, 948, 262; 29/806; 234/94, 106, 130

(56) References Cited

U.S. PATENT DOCUMENTS

| | | | |
|---|---|---|---|
| 3,970,021 | * | 7/1976 | Meadows et al. . |
| 4,797,691 | | 1/1989 | Akiyoshi et al. . |
| 4,846,418 | | 7/1989 | Fairman . |
| 4,860,037 | | 8/1989 | Harvey . |
| 5,106,017 | | 4/1992 | Hicks . |
| 5,157,439 | * | 10/1992 | Sakamoto et al. . |
| 5,277,571 | * | 1/1994 | Brining . |
| 5,461,450 | * | 10/1995 | Long et al. . |
| 5,479,691 | * | 1/1996 | Shimizu et al. . |
| 5,746,100 | * | 5/1998 | Tsuzaki et al. . |
| 6,003,420 | * | 12/1999 | Wakabayashi et al. . |

FOREIGN PATENT DOCUMENTS

| | | |
|---|---|---|
| 554225 | 9/1974 | (CH) . |
| 3727667 A1 | 3/1989 | (DE) . |
| 4023530 A1 | 1/1992 | (DE) . |
| 4124569 A1 | 1/1992 | (DE) . |
| 41 35 787 | 5/1992 | (DE) . |
| 0025711 A1 | 3/1981 | (EP) . |
| 0061773 A1 | 10/1982 | (EP) . |
| 0 329 172 | 8/1989 | (EP) . |
| 0605802 A2 | 7/1994 | (EP) . |
| 1 530 062 | 5/1968 | (FR) . |
| 61-214999 | 9/1986 | (JP) . |
| 4-2800 | 1/1992 | (JP) . |
| 6170794 | 6/1994 | (JP) . |
| 6170795 | 6/1994 | (JP) . |

* cited by examiner

*Primary Examiner*—Kenneth E. Peterson
(74) *Attorney, Agent, or Firm*—Sughrue, Mion, Zinn, Macpeak & Seas, PLLC

(57) ABSTRACT

In an apparatus for manufacturing filmstrips having a variable length and a variable number of perforations from a long strip of continuous film, a die set device is provided with a plurality of punch holders aligned adjacent to one another in a film transporting direction. At least one of the punch holders are selectively actuated to make a designated number of equally spaced perforations at a time. A film length adjusting device is provided for adjusting the length of the continuous film extending between the die set device and a cutter in accordance with a unit length which is determined for each variable length of the filmstrip, such that the cutter and the punch holder or punch holders are actuated in synchronism with each other while the continuous film stops after each transport by the unit length. A pair of feed rollers are disposed between the cutter and a suction drum for transporting the film toward the cutter. The feed rollers have diameters less than that of the suction drum. A side-printer is arranged to record data on the film at a peripheral position of a larger one of the feed rollers.

1 Claim, 13 Drawing Sheets

APPARATUS FOR MANUFACTURING PHOTOGRAPHIC FILMSTRIPS

This is a divisional of application Ser. No. 08/839,773 filed Apr. 15, 1997, the disclosure of which is incorporated herein by reference, now U.S. Pat. No. 6,003,920.

BACKGROUND OF THE INVENTION

1. Field of the Invention

The present invention relates to an apparatus for manufacturing photographic filmstrips from a long strip of photographic film, especially for manufacturing photographic filmstrips having one or two perforations and sections of data per picture frame along one or both of lateral sides thereof by perforating, sections of recording data and cutting the long film.

2. Background Art

Leader-advancing type photographic film cassettes have been disclosed, e.g., in U.S. Pat. No. 4,846,418, in which the whole length of a filmstrip is contained within a cassette shell, and a film leader of the filmstrip can be advanced to the outside of the cassette shell by rotating a spool of the cassette. With this type of film cassette, a camera need not have the sprocket wheel that has conventionally been used for feeding the film leader to the take-up spool of the camera. Once the film leader has been engaged with the take-up spool, the filmstrip may be advanced by rotating the take-up spool. Therefore, the filmstrip of the leader-advancing type cassette need not have a lot of successive perforations which conventional 135-type filmstrips have for engagement with the sprocket wheel or the take-up spool.

Still, in order to advance the filmstrip one frame after each exposure, the filmstrip of the leader advancing type cassette has at least a perforation per picture frame. The perforation is intended to be detected by a photo-sensor in the camera to determine each frame exposure location and position it in an exposure aperture of the camera. Since these perforations for frame positioning are disposed in association with the frame exposure locations, the filmstrip of the leader advancing type cassette, a hereinafter referred to as a new type filmstrip, does not have a positioning perforation in its leader and trailer where no picture frame is to be recorded. Hereinafter, a section which extends over the frame exposure locations of each individual filmstrip will be referred to as a recording section.

For providing perforations only in the recording sections of the filmstrips to be made from the long film, it is not appropriate to use a conventional perforating method for the 135-type film, such as disclosed in JPA 61-214999 and JPY 4-2800, wherein perforations are formed at constant intervals all along the long film while the long film is continuously transported.

For this reason, apparatuses for manufacturing the new type of filmstrip have been suggested, one of which uses a die set having a number of punches and dies corresponding to the number of frame exposure locations to be provided in the individual filmstrips formed from the long film. The apparatus makes the corresponding number of perforations in one punching operation in the recording section of each individual filmstrip. Hereinafter, the number of frame exposure locations per filmstrip will be referred to as the film frame number. A similar method has conventionally been applied to manufacturing 110-type filmstrips.

In FIG. 13 showing such an apparatus, the long film 12 is fed from a roll 10 to a first vacuum suction chamber 15 through dancer roller 13 and a sub-feed rollers 14. The suction chamber 15 transiently stores an appropriate length of the long film 12 before being fed to the die set 17 through a pass roller 16.

The die set 17 has a punch holder 19 with the same number of punches 18 as the film frame number, and a die plate 21 with the corresponding number of dies 20. The punches and dies 18 and 20 are arranged at the same intervals as the frame exposure locations. An air cylinder 22 is driven to move the punch holder 19 down to the die plate 21 while the long film 12 stops on the die plate 21, making the same number of perforations as the film frame number at one time.

Downstream of the die set 17 are disposed a first vacuum suction drum 24, a second vacuum suction chamber 25, a second vacuum suction drum 26, a side-printer 27 and a cutter 28 in serial fashion. The first and second suction drums 24 and 26 have suction holes formed through respective peripheral surfaces, and are driven by servo motors 30 and 32, respectively. Thus, the suction drums 24 and 26 transport the film 12 while sucking it on the peripheral surfaces thereof.

While the first suction drum 24 is driven by the servo motor 30, an encoder 31 connected to the servo motor 30 monitors the rotational amount of the drum 24 to detect the transported length of the film 12. The drum 24 starts rotating after each die-punching operation for forming the perforations P in the film 12, and stops rotating when the film 12 is transported by a unit length which is predetermined in accordance with the film frame number. Thus the next recording section to be perforated is positioned in the die set 17.

The perforated section of the film 12 is transported through the first suction drum 24 to the second suction chamber 25 to transiently store an appropriate length of the film 12 before being fed to the cutter 28. The film 12 is transported from the suction chamber 25 to the cutter 28 through the second suction drum 26, while an encoder 33 connected to the servo motor 32 monitors the rotational amount of the second suction drum 26 to detect, the transported length of the film 12. The detection signal from the encoder 33 is sent to the side-printer 27.

In synchronism with the detection signal, the side-printer 27 optically records data such as the name of film manufacturer, frame serial numbers and the like as latent images of characters and bar codes along one or both of lateral sides of the film 12 while the film 12 is being transported through the second suction drum 26. The side-printer 27 is movable toward a peripheral position of the second suction drum 26 where the transported film 12 is tightly held, so that the side-printer 27 faces the photosensitive emulsion surface of the film 12 at a constant distance. The peripheral position may be referred to as a side-print position.

The second suction drum 26 stops rotating when it has transported the film 12 by the predetermined unit length. Then, the cutter 28 is actuated to cut the film 12 into individual filmstrips.

Meanwhile, the new type filmstrip may have variations in the film frame number like conventional filmstrips. To cope with the different film frame numbers, the apparatus as shown in FIG. 13 is provided with interchangeable punch holders having different numbers of punches. One of the punch holders is selected in correspondence with the film frame number of the filmstrips designated to be produced. Also the unit length for the transport of the film 12 through the suction drums 24 and 26 is changed in accordance with the selected film frame number. Although the film length extending from the die set 17 to the cutter 28 changes with the change of the unit length, the second suction chamber 25 absorbs the variation by changing the storing length of the film 12. It is to be noted that the side-print position is unchanged regardless of the film frame number. Of course, the number of times of recording as well as a side-print end position vary depending on the film frame number, as a side-print end position.

Since the above-described apparatus needs two suction drums 24 and 26, two servo motors 30 and 32, and two encoders 31 and 33 for transporting the film 12 by the unit length relative to the die set 17 and the cutter 28, respectively, its mechanism and control system are complicated. Moreover, since the drums 24 and 26 must have a diameter large enough to ensure the suction of the film 12, the distance between the cutter 28 and side-printer 27, and thus the length of the film 12 from a cut position B to the side-print position C must correspondingly be long, as is shown in FIG. 14, wherein the cut position B is a position to cut trailing ends 6 of individual filmstrips 5, that is, an innermost end in a cassette shell. However, to make use of as much area of the individual filmstrip 5 as possible, it is desirable to limit a film trailer length L3 to a range from 50 mm to 100 mm or so, wherein the film trailer length L3 represents the length from the trailing end 6 of the individual filmstrip 5 to the start of its recording section. When using the apparatus as shown in FIGS. 13 and 14, the length from the cut position B to the side-print position C is beyond the desirable trailer length L3, as is shown in FIG. 15.

To solve this problem, it is necessary in the above-described apparatus to start side-printing while the film 12 is transported through the drum 26, interrupt side-printing while the film 12 stops to be cut by the cutter 28, and restart side-printing in synchronism with the start of the next film transport. Because the transport speed of the film inevitably changes immediately before and after the film stops, side-printed images may be damaged at the interrupted portion.

OBJECT OF THE INVENTION

In view of the foregoing, an object of the present invention is to provide a simple and efficient filmstrip manufacturing apparatus which has a perforator capable of making a variable number of perforations at one time in a long continuous film and a cutter for cutting the continuous film into individual filmstrips at a variable length corresponding to the number of perforations.

Another object of the present invention is to provide a filmstrip manufacturing apparatus which has a side-printer between a perforator and a cutter, the side-printer being capable of printing data on the long film along one or both lateral sides of recording sections of individual filmstrips to be made from the long film, without the need for interrupting the side-printing in the middle of each recording section.

SUMMARY OF THE INVENTION

To achieve the above objects, in an apparatus for manufacturing filmstrips having a variable length and a variable number of perforations from a long strip of continuous film, the present invention provides a die set device having a plurality of punch holders aligned adjacent to one another in a film transporting direction. At least one of the punch holders are selectively actuated to make one designated number of equally spaced perforations at a time. A film length adjusting device is provided for adjusting the length of the continuous film extending between the die set device and a cutter in accordance with a unit length which is predetermined for each variable length of the filmstrip. Thereby, the cutter and the punch holder or punch holders can be actuated in synchronism with each other while the continuous film stops after each transport by the unit length.

The film length adjusting device sets the length of the continuous film from a cut position of the cutter to a punching position of the die set device into a value that is a number M times as long as the unit length, plus a length from a first end of each filmstrip, which is to be cut at the cut position, to a first perforation to be made at the punching position in each filmstrip.

According to a preferred embodiment, a suction drum is disposed between the die set and the cutter, to transport the film toward the cutter by a unit length after each die-punching, and a pair of feed rollers are disposed between the cutter and the suction drum. The feed rollers have diameters that are less than that of the suction drum, and one of the feed rollers has a larger diameter than the other. A side-printer is arranged to record data on the film at a peripheral position of the larger feed roller. In this way, it is possible to dispose the side-printer closer to the cutter close enough to continue side-printing without intermediate stops in the recording section of each filmstrip. The distance between the cut position and the peripheral position for side-printing is preferably equal to or less than the length from the first end to the first perforation of each filmstrip.

BRIEF DESCRIPTION OF THE DRAWINGS

Other objects and advantages of the present invention will become apparent in the following detailed description of the preferred embodiments when read in connection with the accompanying drawings, wherein like reference numerals designate like or corresponding parts throughout the several views, and wherein.

DETAILED DESCRIPTION OF THE PREFERRED EMBODIMENTS

Figure 1:
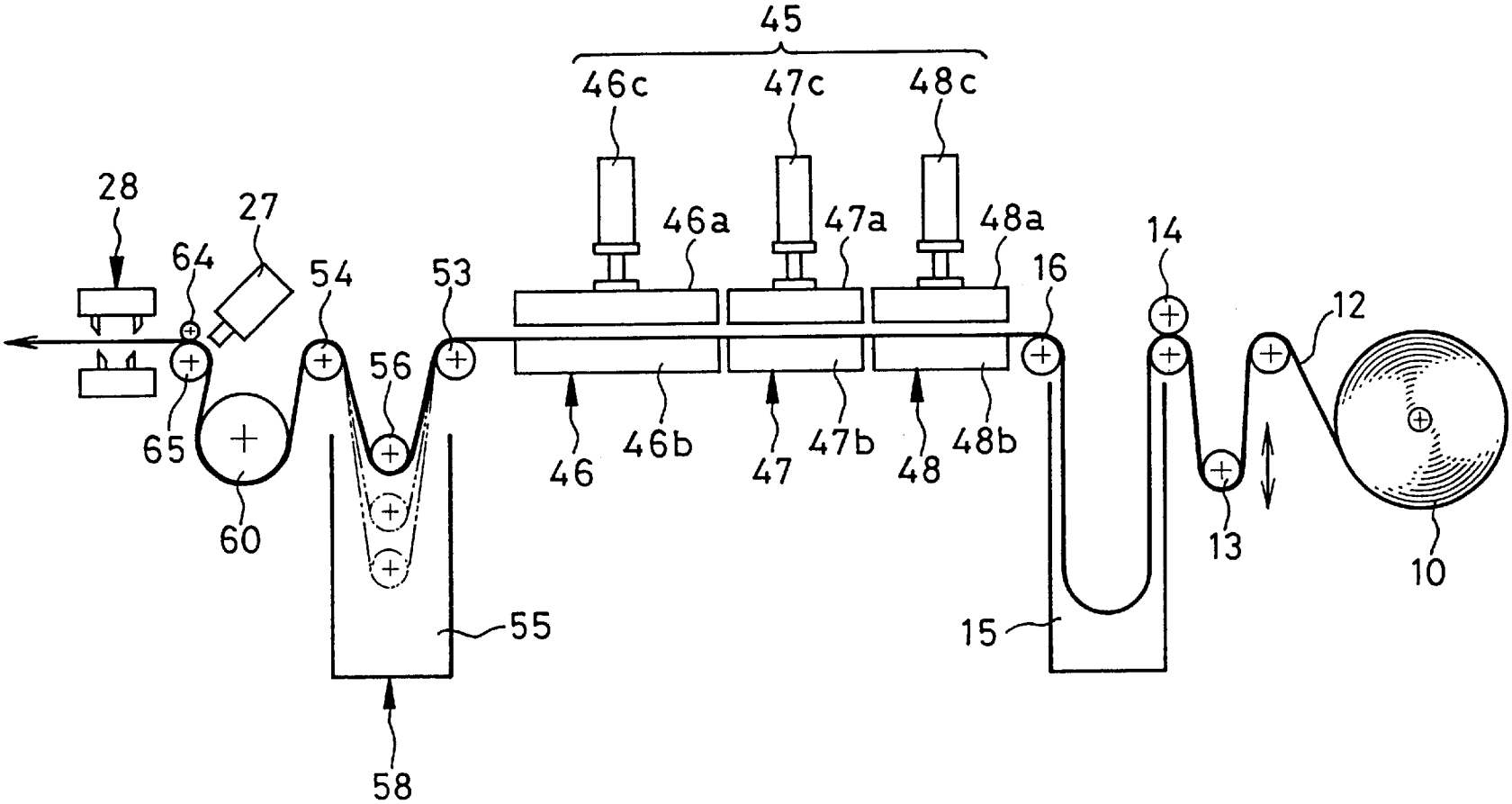
FIG. 1 is a schematic diagram illustrating a filmstrip manufacturing apparatus according to a preferred embodiment of the invention.
Figure 2:
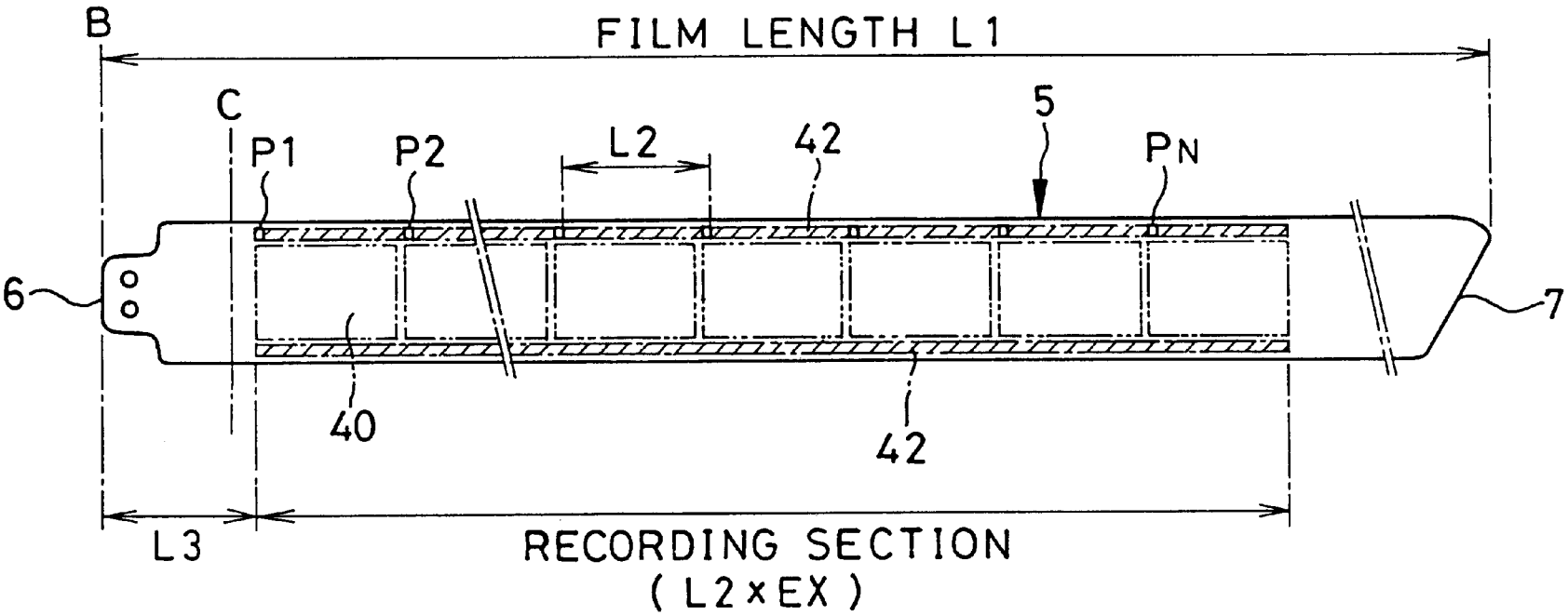
FIG. 2 is a schematic diagram illustrating an example of filmstrip to be manufactured by the apparatus according to the invention.

In FIG. 1, a filmstrip manufacturing apparatus is adapted to manufacture filmstrips in a format as shown in FIG. 2, wherein each film exposure location 40 is designated by a perforation P. The filmstrip 5 has a length L1 which is variable depending on its film frame number N, i.e., the number of the frame exposure locations 40 to be provided in the filmstrip 5. The perforations P1 to $P_N$ are disposed at constant intervals L2 in a recording section of each individual filmstrip 5. As shown by hatching, both lateral sides of the filmstrip 5 serve as side-print zones 42.

Figure 13:
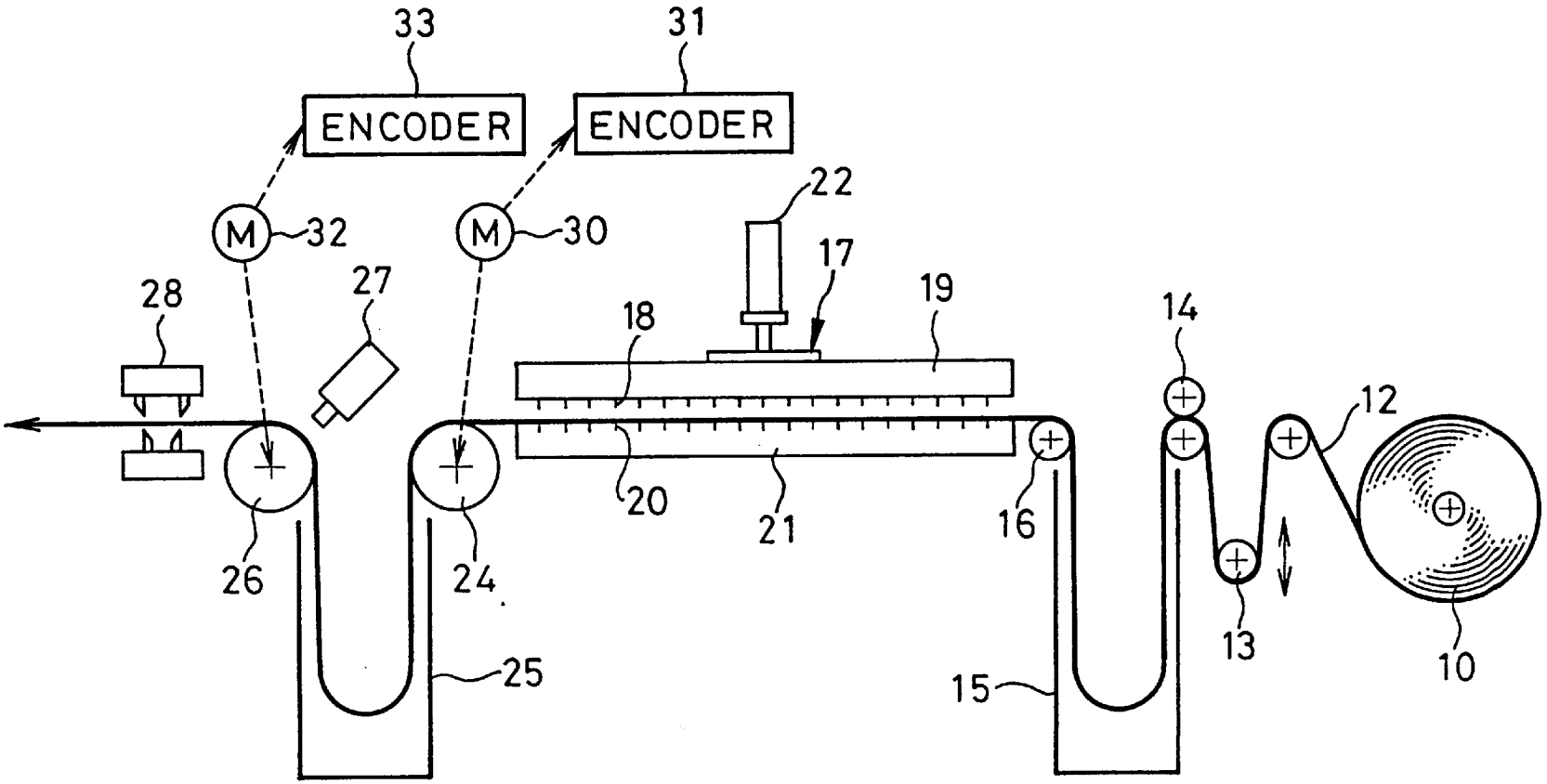
FIG. 13 (PRIOR ART)
FIG. 13 is a schematic diagram illustrating a filmstrip manufacturing apparatus as a background of the invention.
Figure 15:
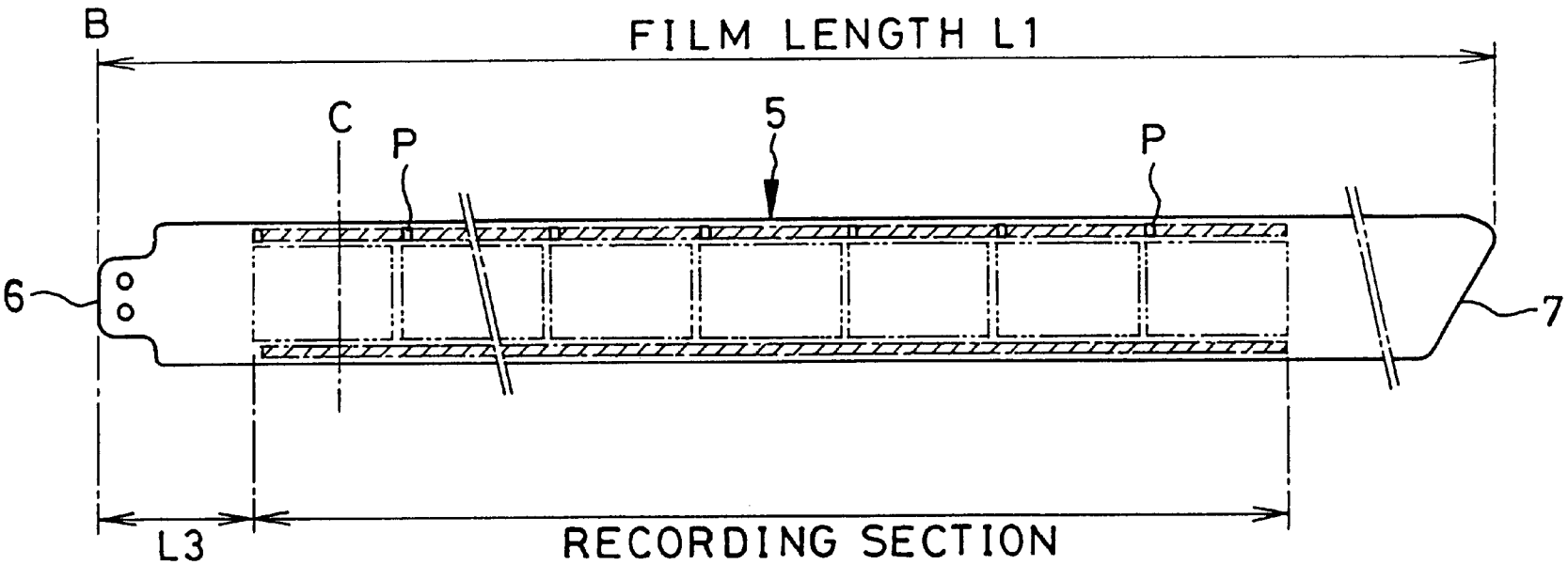
FIG. 15 (PRIOR ART)
FIG. 15 is a schematic diagram illustrating a relationship between a side-print position C and a cut position B of the apparatus shown in FIG. 13, relative to a filmstrip.

A long continuous strip of film 12 is fed from a roll 10 through a dancer roller 13, sub-feed rollers 14, a vacuum suction drum 15 and a pass roller 16 into a die set device 45, like the apparatus shown in FIG. 13. The die set device 45 is constituted of first to third die sets 46, 47 and 48 which are aligned in continuity along a film transport path, and may be individually actuated.

Figure 3:
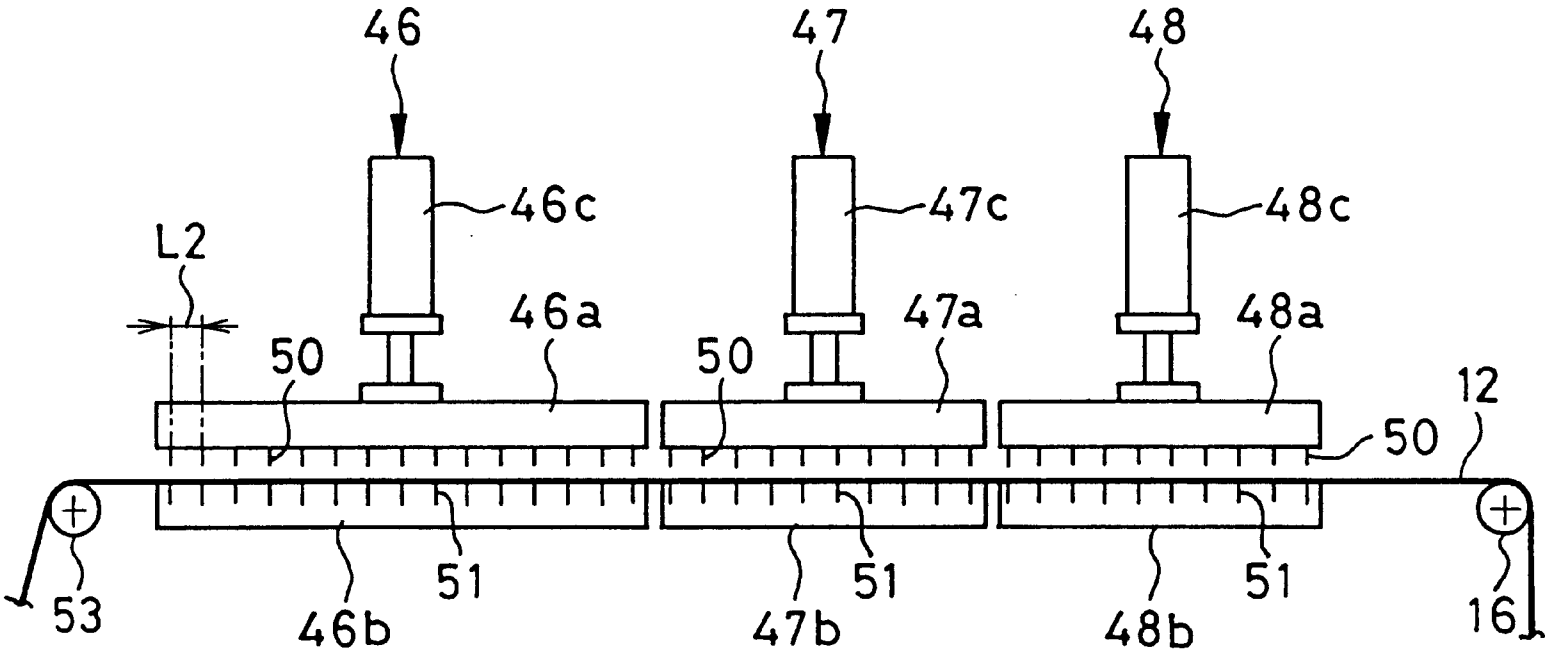
FIG. 3 is a schematic diagram illustrating the die set unit of the apparatus shown in FIG. 1.

As shown in FIG. 3, the first die set 46 is constituted of a punch holder 46*a* having fifteen punches 50 arranged at the same interval L2 as the perforations P1 to $P_N$, a die plate 46*b* having fifteen dies 51 arranged in correspondence with the punches 50, and an air cylinder 46*c* for moving the punch holder 46*a* downward. The second and third die sets 47 and 48 are each constituted of a punch holder 47*a* or 48*a* having ten punches 50 arranged at the same interval L2 as the perforations P1 to $P_N$, a die plate 47*b* or 48*b* having ten dies 51 arranged in correspondence with the punches 50, and an air cylinder 47*c* or 48*c* for moving the punch holder 47*a* or 48*a* downward. The three die sets 46, 47 and 48 are arranged such that all the punches 50 and the dies 51 as well are spaced at the same interval L2 along the film transport path.

The die set device 45 can make a series of perforations P1 to $P_N$ in each stroke of die-punching while selecting the film frame number N among three variations: 15-exposure, 25-exposure and 35-exposure formats. To make 15-exposure format filmstrips, only the first die set 46 is actuated. To make 25-exposure format filmstrips, the first and second die sets 46 and 47 are actuated simultaneously. For 35-exposure format filmstrips, all the three die sets 46 to 48 are simultaneously actuated. Since the die plates 46*b*, 47*b* and 48*b* are stationary, and the same effect is achieved by merely actuating the punch holders 46*a*, 47*a* and 48*a*, the die plates 46*b*, 47*b* and 48*b* may be replaced by a single die plate extending over the three punch holders 46*a* to 48*a*.

At a film exit of the die set device 45 is disposed a film length adjusting mechanism 58 which is constituted of pass rollers 53 and 54, and a movable roller 56 which is movable in a vertical direction inside a chamber 55 which is disposed between the pass rollers 53 and 54. A vacuum suction drum 60 is disposed downstream of the film length adjusting mechanism 58, to transport the long film 12 by a unit length which is predetermined in accordance with the film frame number N. The suction drum 60 sucks the long film 12 by suction holes formed through a peripheral surface of the drum 60. The suction drum 60 is driven by a servo motor 61, while an encoder 62 monitors the rotational amount of the suction drum 60 through the servo motor 61.

The long film 12 is transported from the suction drum 60 to a cutter 28 through a pair of feed rollers consisting of a capstan roller 65 driven by the motor 61, and a pinch roller 64 for pressing the long film 12 onto the capstan roller 65. A side-printer 27 is disposed near the feed roller 65 to print film data as character data and bar code data along both lateral sides of the long film 12 in the side-print zone 42 of the individual filmstrips 5 to be formed from the long film 12. The cutter 28 cuts off the individual filmstrips 5 from the long film 12 at the variable length L1. The cutter 28 has first and second knife edges 28*a* and 28*b* respectively for cutting a trailing end 6 of a filmstrip 5 and a leading end 7 of an adjacent preceding filmstrip 5 in the long film 12.

Figure 5:
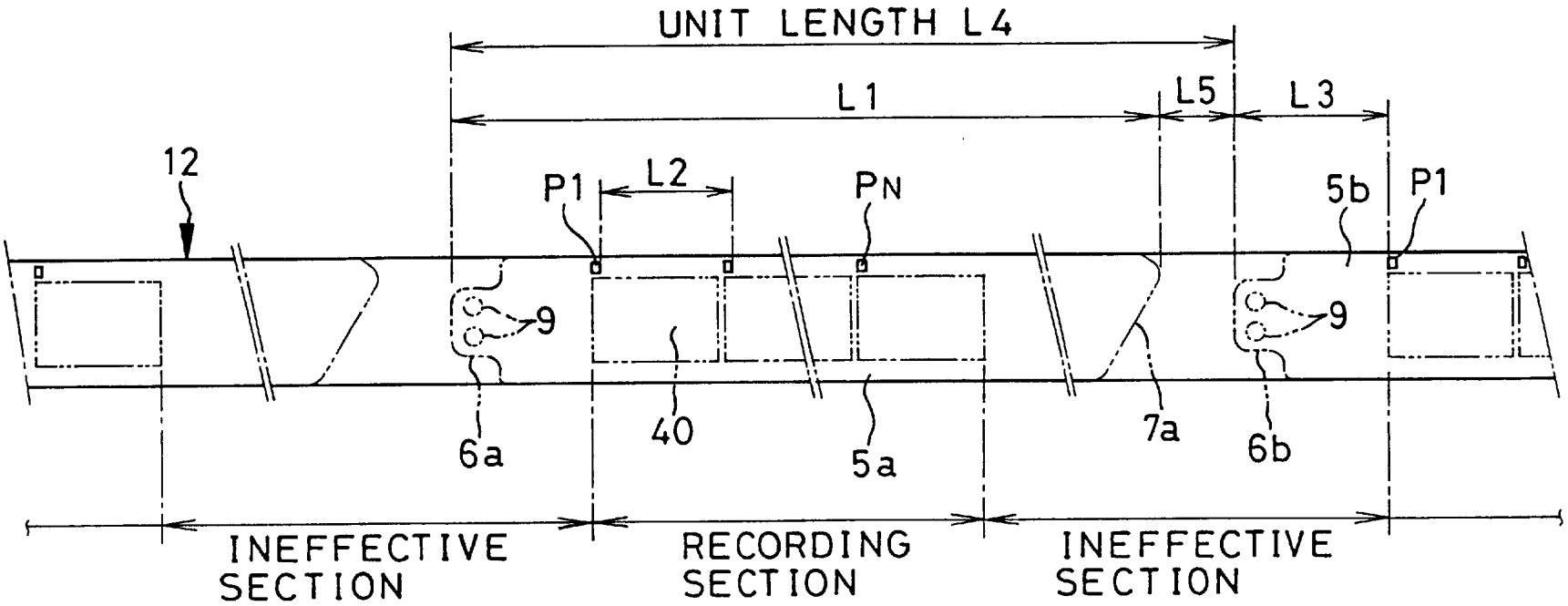
FIG. 5 is a schematic diagram illustrating a long strip of film and the individual filmstrips to be formed from the long film.

FIG. 5 shows the relationship between the long film 12 and two adjacent filmstrips 5*a* and 5*b* to be cut off therefrom. When the cutter 28 makes a stroke, a leading end 7*a* of the preceding filmstrip 5*a* and a trailing end 6*b* of the following filmstrip 5*b* are simultaneously cut by the edges 28*b* and 28*a* of the cutter 28, respectively. Since a trailing end 6*a* of the preceding filmstrip 5*a* has been cut at the preceding cutting stroke, the filmstrip 5*a* is cut off from the film 12 when its leading end 7*a* is cut by the edge 28*b*.

In correspondence with the spacing between the knife edges 28*a* and 28*b*, a blank having a constant length L5 is provided between the leading end 7*a* and the trailing end 6*b*. Accordingly, the film 12 is transported by a unit length L4=L1+L5 after each stroke of the cutter 28. The cutter 28 preferably has a pair of punches in addition to the knife edges 28*a* and 28*b* to provide engaging holes 9 concurrently with cutting the long film 12 into individual filmstrip 5, the engaging holes 9 being used to secure the trailing end 6 to a spool of a photographic film cassette.

Figure 4:
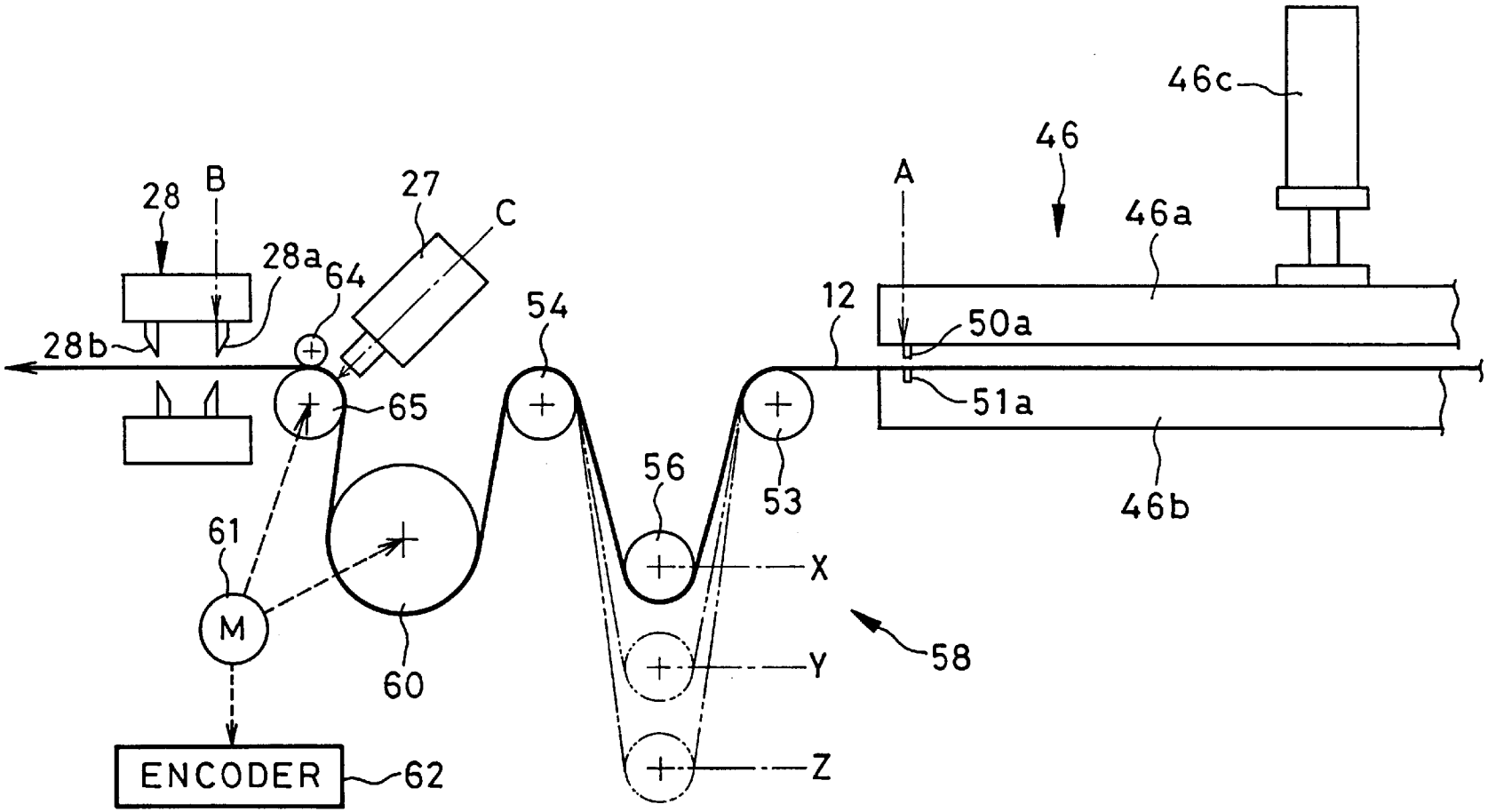
FIG. 4 is an enlarged schematic diagram illustrating the film length adjusting device of the apparatus shown in FIG. 1.
Figure 6:
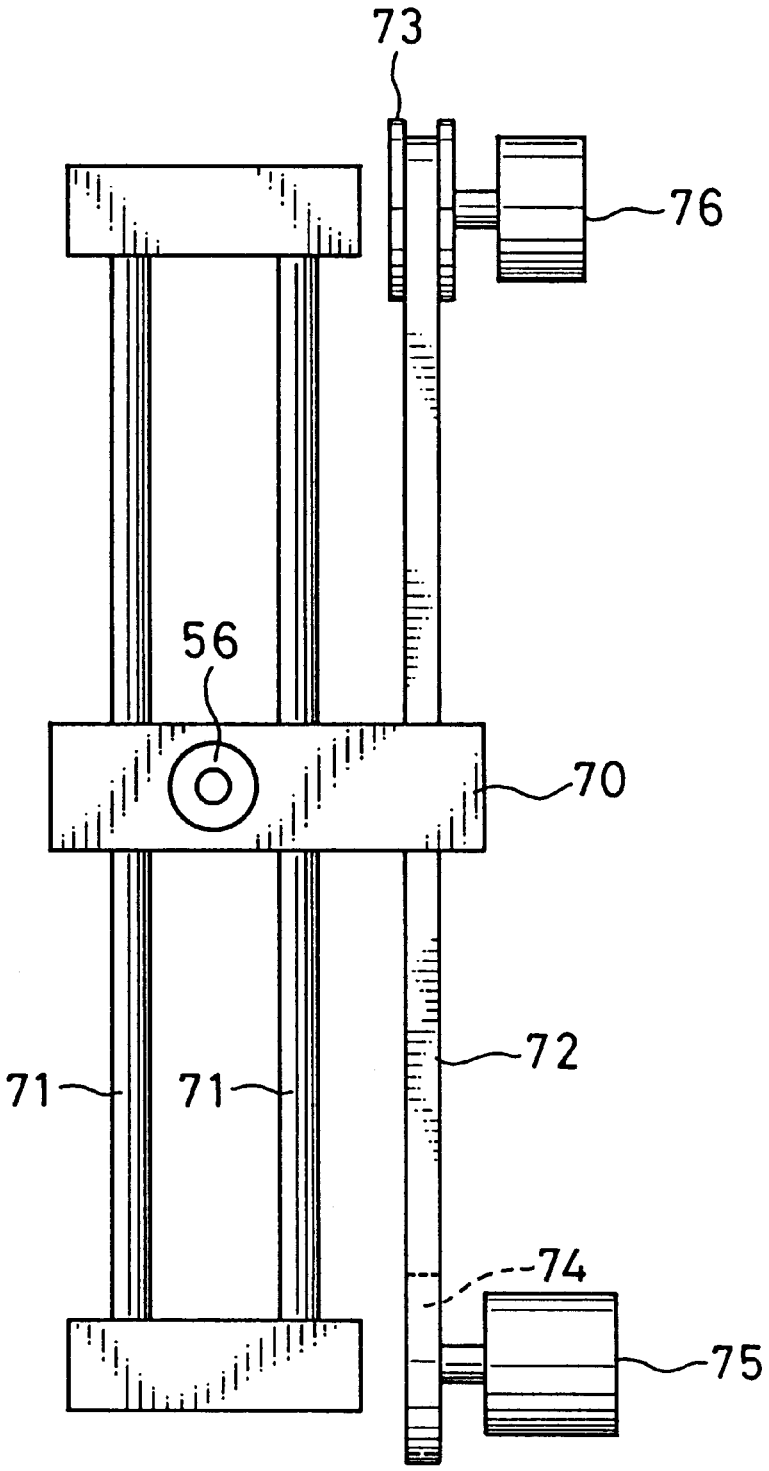
FIG. 6 is a diagram illustrating an embodiment of the film length adjusting device shown in FIG. 4.
Figure 7:
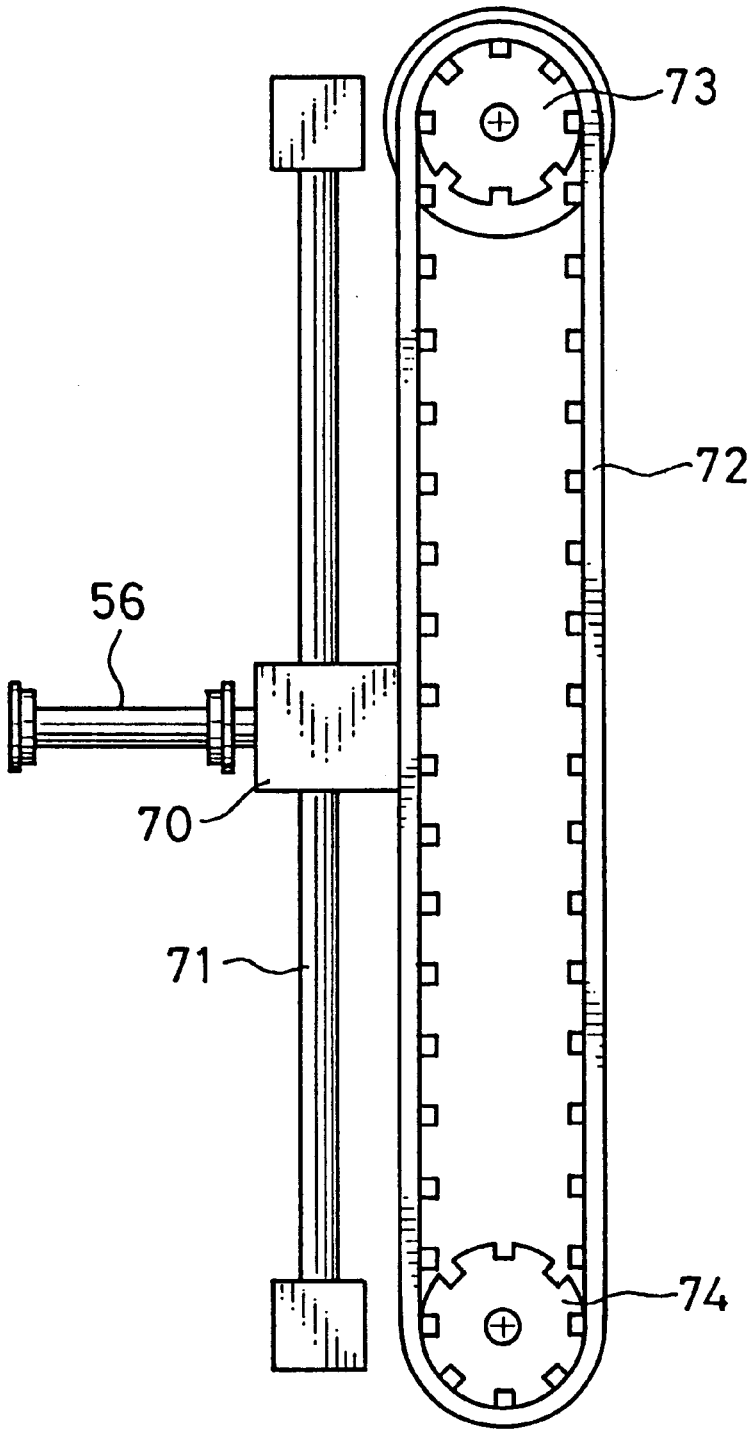
FIG. 7 is a side view of the film length adjusting device shown in FIG. 6.

The film length adjusting mechanism 58 is adapted to adjust the length of the film 12 extending between a cut position B defined by the knife edge 28*a* of the cutter 28 and a punching position A defined by the leftmost punch and die 50*a* and 51*a* of the first die set 46 in FIG. 4. As shown in FIGS. 6 and 7, the movable roller 56 is movably mounted to a supporting block 70 which is movable along a pair of vertical guide shaft 71.

A timing belt 72 is securely connected to the supporting block 70, and is suspended between teethed pulleys 73 and 74. The pulley 74 is driven by a servo motor 75 to move the supporting block 70 and thus the movable roller 56 in the vertical direction. An encoder 76 is connected to the other pulley 73 to detect position of the movable roller 56. The movable roller 56 may be stopped at one of three predetermined positions X, Y and X, as is shown in FIG. 4, such that the length of the film 12 extending from the cut position B to the punching position A, hereinafter referred to as a film buffer length, is set at a value determined based on the unit length L4 for the designated kind of filmstrip, and a film trailer length L3 as well. The film trailer length L3 is the length from the trailing end 6 to a first perforation P1 of the individual filmstrip 5, which is to be formed by the die and punch 50*a* and 51*b* at the punching position A.

In other words, when the film 12 stops to be cut by the cutter 28, the length of the film 12 between a trailing end 6 being positioned at the cut position B, on one hand, and a trailing end 6 of a filmstrip 5 being positioned in the die set device 45, on the other hand, is set at a value an integral number M of times as long as the unit length L4 for the designated kind filmstrips. Accordingly, it is possible to actuate the die set device 45 and the cutter 28 in synchronism with each other each time the film 12 stops after being transported by the unit length L4.

In this embodiment, the movable roller 56 is moved to the position X when manufacturing 15-exposure filmstrips from the film 12, to set the film buffer length M times as long as a unit length L4*a* for 15-exposure filmstrip, plus the film trailer length L3, that is, L4*a*×M+L3. When manufacturing 25-exposure filmstrips, the movable roller 56 is moved to the position Y, so that the film buffer length becomes M times as long as a unit length L4*b* for 25-exposure filmstrip, plus the film trailer length L3, that is, L4*b*×M+L3. When the movable roller 56 moves to the position Z, the film buffer length is M times as long as a unit length L4*c* for 35-exposure filmstrip, plus the film trailer length L3, that is, L4*c*×M+L3. The positioning of the movable roller 56 may be manually executed, so the servo motor 75 is dispensable.

Alternatively, it is possible to assign the position Z of the movable roller 56 to the 15-exposure filmstrips, and the position Y to the 25-exposure filmstrips by using a larger integral number M+α as a factor to define the film buffer length for the 15-exposure filmstrips than an integral number M which is used as a factor to define the film buffer length for the 25-exposure filmstrips. In that case, the position X may be assigned to the 35-exposure filmstrips by using a smaller integral number M−α as a factor to define the film buffer length for the 35-exposure filmstrips.

The feed roller 65 is rotated at the same circumferential speed as that of the suction drum 60 so the film 12 may not be loosened. In order to ensure a constant distance from the side-printer 27 to the film 12 at the side-print position C, the side-print position C is set in a peripheral position of the feed roller 65 where the film 12 is in tight contact with the roller 65. The roller 64 ensured the tight contact of the film 12 with the roller 65. In order to tense the film 12 at the side-print position, it is possible to set the circumferential speed of the feed roller 65 slightly, i.e. 1% or less, higher than the circumferential speed of the suction drum 60.

Figure 8:
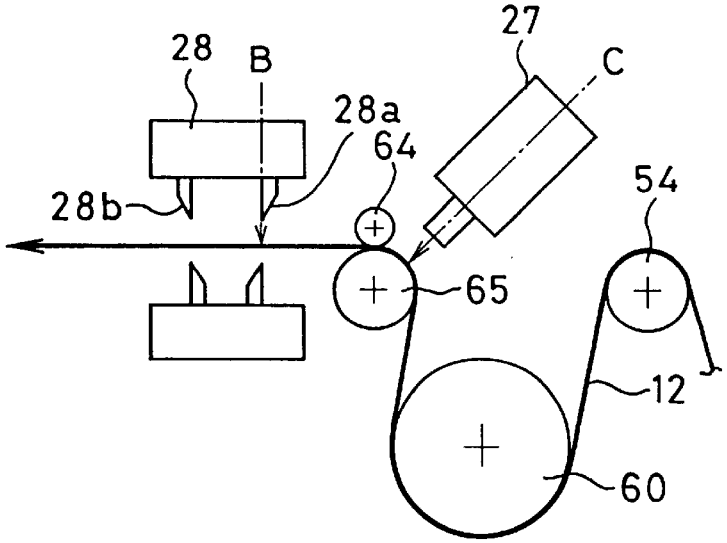
FIG. 8 is an enlarged schematic diagram illustrating a side-print position C and a cut position B of the embodiment shown in FIG. 1.
Figure 14:
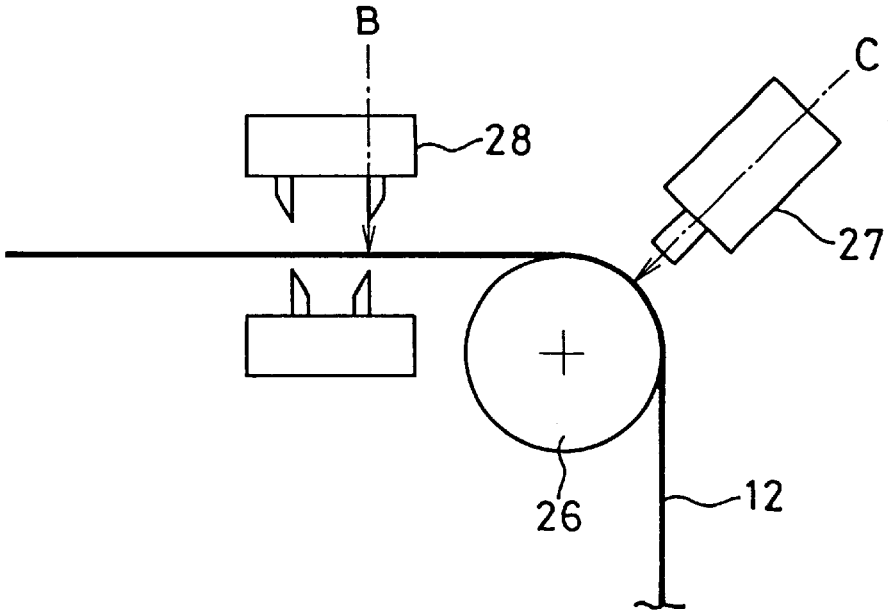
FIG. 14 (PRIOR ART)
FIG. 14 is an enlarged schematic diagram illustrating a side-printer and a cutter of the apparatus shown in FIG. 13.

Since the feed roller 65 has a smaller diameter than the suction drum 60, the side-printer 27 may be disposed closer to the cutter 28, as is shown in FIG. 8, compared with the case shown in FIG. 14. Accordingly, it is possible to make the distance between the side-print position C and the cut position B equal to or less than the film trailer length L3, as is shown in FIG. 2. The distance between the positions B and C may be about 50 mm to 100 mm, preferably 50 mm to 70 mm, and more preferably 60 mm to 70 mm. In this way, when the film 12 stops to be cut by the cutter 28, the print position C is located before or at the first perforation P1 defining the start or front end of the recording section in the film transporting direction. Accordingly, side-printing can be performed without intermediate stops through the recording section of each individual filmstrip.

Figure 9:
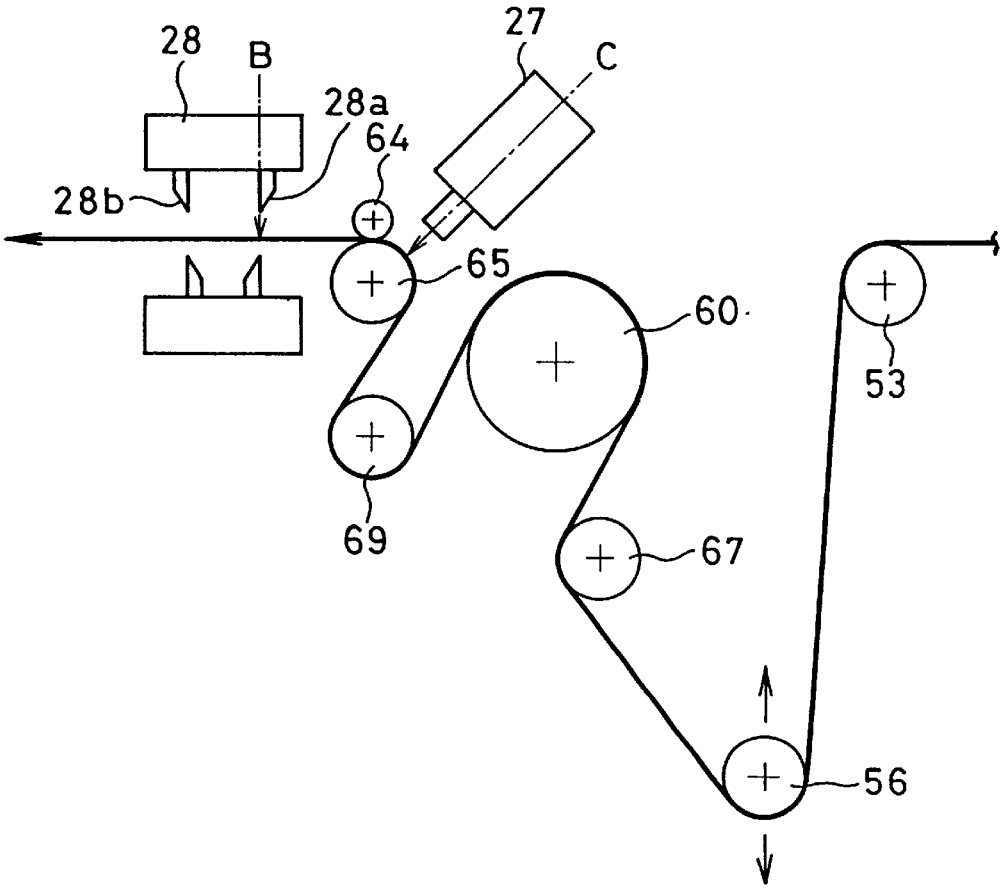
FIG. 9 is an enlarged schematic diagram illustrating a film transporting system according to another preferred embodiment of the present invention, wherein the long film comes into contact at its base surface with the suction drum.

It is preferable to provide pass rollers 67 and 69 in a manner as shown in FIG. 9, instead of the pass roller 54, so that the photosensitive emulsion surface of the film 12 will not contact the suction drum 60. This embodiment prevents the photosensitive emulsion surface of the film 12 from being scratched or damaged by sucking.

Figure 10:
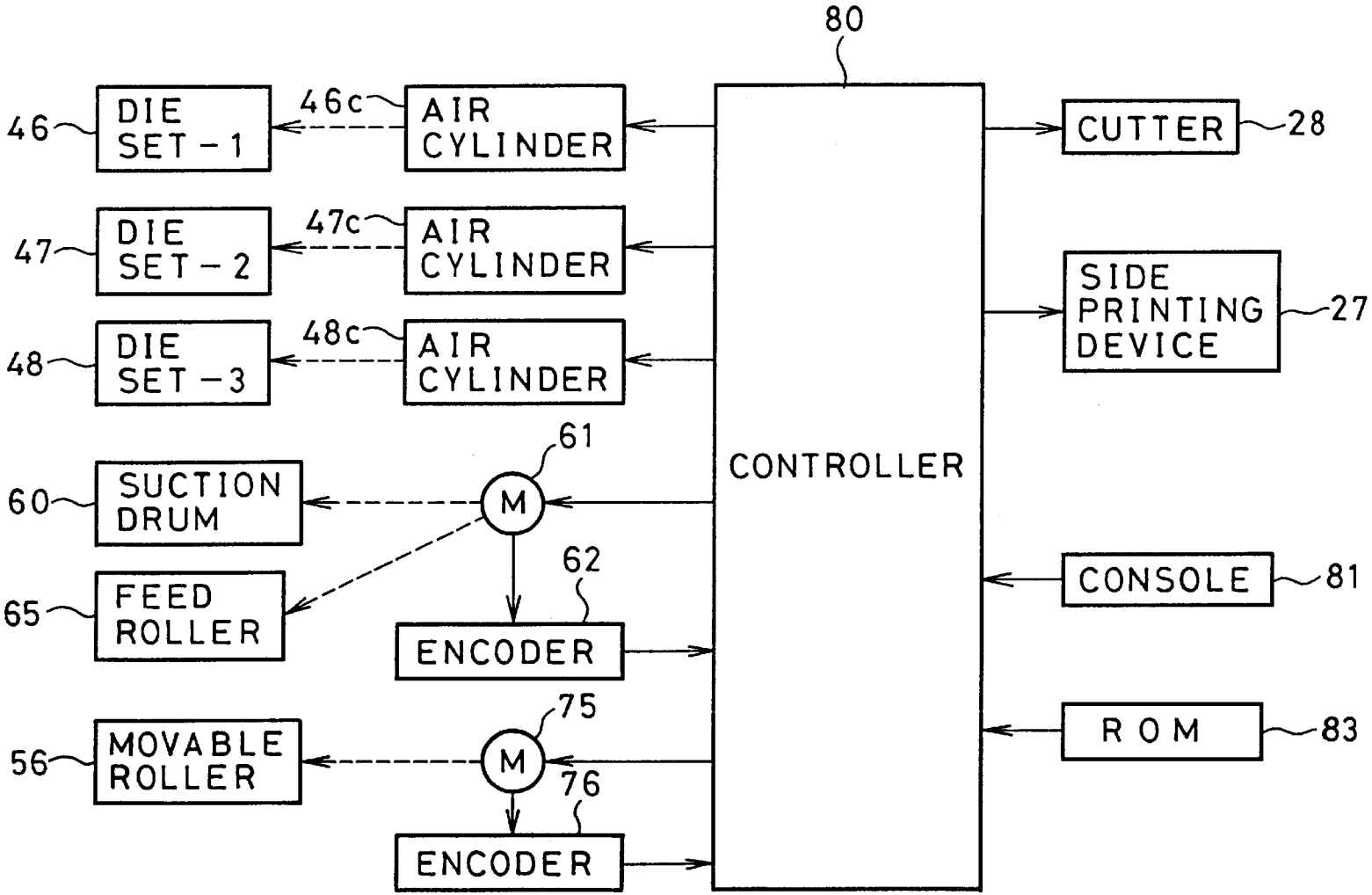
FIG. 10 is a block diagram of the apparatus

The operation of the above-described apparatus is controlled by a controller 80, as shown in FIG. 10. A console 81 serves as an input device for the operator to enter the film frame number N of the filmstrips to be manufactured. In correspondence with the entered film frame number N, the controller 80 selectively drives the air cylinders 46*c*, 47*c* and 48*c* to actuate the first, or the first and second, or all of the die sets 46, 47 and 48, to form fifteen, twenty-five, or thirty-five perforations at one time, respectively.

Thereafter, the controller 80 drives the servo motor 61 to rotate the suction drum 60 to transport the film 12 by the unit length L4, which is determined in accordance with the film frame number N, while monitoring output signals from the encoder 62. The controller 80 concurrently drives the servo motor 75 to move the movable roller 56 into one of the three positions X, Y and Z in accordance with the film frame number N, while monitoring output signal from the encoder 76. The controller 80 also actuates the side-printer 27 and the cutter 28 with respect to the output signal from the encoder 62 under the control of the controller 80. The controller 80 sequentially controls the respective parts in accordance with a program stored in a ROM 83.

The above-described apparatus operates as follows:

After loading the roll 10, the operator enters the film frame number N, e.g., N=15, through the console. Then, the controller 80 moves the movable roller 56 in the position X through the servo motor 75, and rotate the suction drum 60, the feed rollers 64 and 65 through the servo motor 61 to transport the film 12 toward the cutter 28. When the film 12 is positioned in the die set device 45 by transporting the film 12 a certain amount from the roll 10, the controller 80 actuates the first die set 46 through the air cylinder 46*c* to make fifteen perforations P1 to P15 through the film 12. Simultaneously, the cutter 28 is actuated to cut a portion of the film 12 where no perforation is made. Thereafter, the film 12 is transported by the unit length L4*a* for 15-exposure filmstrip.

When die-punching and transporting of the film 12 by the unit length L4*a* are repeated a number of times corresponding to the film buffer length provided at the position X of the movable roller 56, the trailing end 6 of the filmstrip 5 having the fifteen perforations in its recording section is placed in the cut position B. Simultaneously therewith, the next recording section to be perforated is placed between the punch holder 46*a* and the dies plate 46*b* of the first die set 46. Then, the controller 80 stops transporting the film 12, and actuates the cutter 28 and the first die set 46 at the same time. Thereafter the film 12 is transported by the unit length L4*a*, and then the first die set 46 is actuated and, simultaneously, the cutter 28 is actuated to cut the trailing end 6 of the next filmstrip 5 and the leading end 7 of the filmstrip 5 whose trailing end 6 has previously been cut. As a result, the filmstrip 5 with fifteen perforations is cut off the film 12 into an individual 15-exposure filmstrip. In this way, die-punching and cutting are performed in synchronism with each other.

While the film 12 is transported by the unit length L4*a* after each cutting, the side-printer 27 starts printing when the front end of the recording section immediately after the first perforation P1 is located in the prints position C, and continuously print data of 15-exposure filmstrip along the side-print zone 42 in the recording section. Preferably, the side-printer 27 is disposed relative to the cutter 28 such that the side-printer 27 can start printing immediately after the start of film transport.

When changing the film frame number N, e.g., to N=25, the operator enters a stop signal and the film frame number N=25 through the console. Then, the controller 80 stops activating the die set device 45, the side-printer and the cutter 28 after the film 12 is transported by the unit length L4*a* for 15-exposure filmstrip following a die-punching of the first die set 46. Thereafter, the movable roller 56 is moved to the position Y to adjust the film buffer length between the cut position B and the punching position A to the unit length L4*b* for 25-exposure filmstrip.

Then, the first and second die sets 46 and 47 are simultaneously actuated to make twenty-five perforations P1 to P25 at a time through the film 12 and, thereafter, the suction drum 60 is driven to transport the film 12 by the unit length L4*b* for 25-exposure filmstrip. Since the leading end and the trailing end of two adjacent filmstrips having fifteen perforations P1 to P15 formed therethrough are cut by the cutter 28 in synchronism with the die-punching of the first and second die sets 46 and 47, the preceding one of the two filmstrips is cut off the film 12 into an individual 15-exposure filmstrip. But the leading end of the following filmstrip is transported farther than the cutter 28 as a result of the rotation of the suction drum 60 by the unit length L4*b* for 25-exposure filmstrip.

Accordingly, defective filmstrips will be produced until the leading end of the filmstrip having twenty-five perforations P1 to P25 reaches the cutter 28. To minimize the number of defective filmstrips at the film frame number change, it is preferable to determine the film buffer length to be L4+L3 for any film frame number N, by selecting a factor "1" to multiply the unit length L4 in the above-described definition. In this way, merely a defective filmstrip will be produced at each film frame number change.

Thereafter, die-punching of the first and second die sets 46 and 47 and cutting of the cutter 28 are repeated in synchronism with each other, and the side-printer 27 prints data of 25-exposure filmstrip along the side-print zone 42 while the film 12 is transported by the unit length L4*b* after each die-punching, in the same way as above, to produce 25-exposure filmstrips.

When the operator designates the film frame number N=35, the movable roller 56 is moved to the position Z to adjust the film buffer length to the unit length L4*c* for 35-exposure filmstrip. Then, the first to third die sets 46 to 48 are simultaneously actuated to make thirty-five perforations P1 to P35 at a time. Thereafter, the suction drum 60 is driven to transport the film 12 by the unit length L4*c,* while the side-printer 27 prints data of 35-exposure filmstrip along the side-print zone 42. The same operation is repeated to produce 35-exposure filmstrips in continuous succession.

Figure 11:
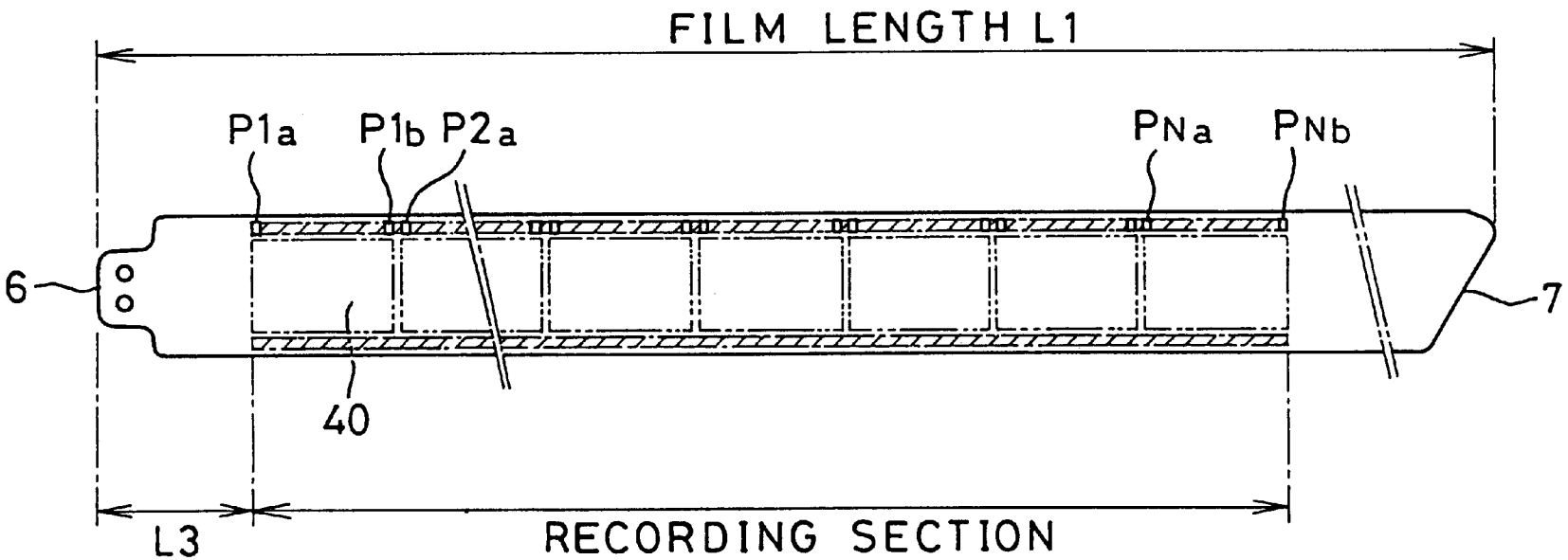
FIG. 11 is a schematic diagram illustrating a filmstrip of another format.

Although the above-described embodiment relates to a case where a single perforation is provided in association with each frame exposure location, the present invention is applicable to a case where a pair of perforations P1*a* and P1*b;* P2*a* and P2*b*; . . . $P_N$a and $P_N$b are provided for each frame exposure location, as is shown in FIG. 11. Two perforations for assigning longitudinal ends of each frame exposure location facilitate more accurate positioning of the frame exposure location in the exposure aperture of the camera. It is also possible to dispose a pair of perforations on opposite lateral sides of each frame exposure location.

Figure 12:
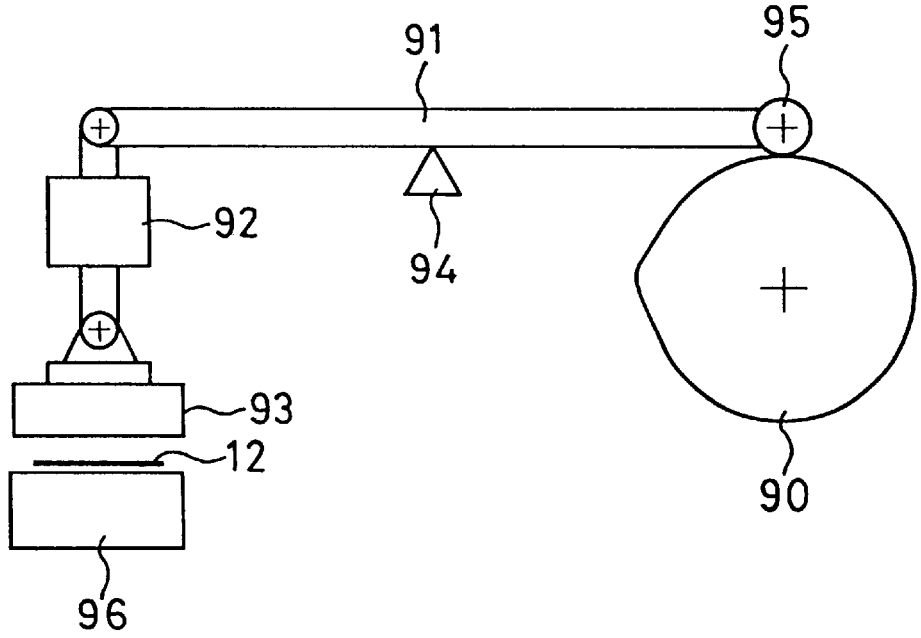
FIG. 12 is a schematic diagram of a die set according to another embodiment of the invention.

Although the air cylinders 46*c,* 47*c* and 48*c* are selectively driven by the controller 80 for each die-punching stroke of the associated die sets 46 to 48, it is also possible to provide a cam 90 and a lever 91, as is shown in FIG. 12, for actuation of each punch holder 93. In this embodiment, the lowermost position of the punch holder 93 in the die-punching stroke is changed over by an air cylinder 92 connected to the punch holder 93, between an active position and an inactive position. The cam 90 is connected to the air cylinder 92 through the lever 91. The lever 91 has a cam follower 95 at its one end, the cam follower 95 always contacts the cam surface of the cam 90, and is connected to the air cylinder 92 at the opposite end, with its fulcrum 94 disposed at an intermediate position.

Accordingly, one rotation of the cam 90 causes one stroke of the punch holder 93. When the lowermost position of the punch holder 93 in the stroke is set in the inactive position by the air cylinder 92, the punch holder 93 cannot perforate the film 12 placed on a dies plate 96. Though FIG. 12 shows only one punch holder 93, a plurality of such punch holders 93 are disposed along the film 12, and only those punch holders 93 which are set in the active position by the associated air cylinders 92 can effect die-punching by one stroke. This embodiment is suitable for a faster die-punching operation.

Although the cam 90 and the lever 91 are provided for each die set, and are actuated in synchronism with one another in the above-embodiment, it is possible to actuate a plurality of punch holders with air cylinders by a single cam and a lever.

The present invention is not only applicable to manufacturing photographic filmstrips, but also to manufacturing other kinds of strips or webs from a long strip of resin film or paper.

Thus, the present invention should not be limited to the embodiments shown in the drawings, but on the contrary, various modifications may be possible without departing from the scope of the appended claims.

What is claimed is:

1. An apparatus for manufacturing filmstrips from a long strip of continuous film, each filmstrip having a variable length and a variable number of perforations, said apparatus comprising:

a designating device for designating the number of perforations per filmstrip;

a die set device comprising a plurality of punch holders aligned adjacent to one another in a film transporting direction, each of said punch holders having a plurality of punches, at least a dies plate having dies as counterparts to said punches, and an actuation mechanism for selectively actuating at least one of said punch holders in accordance with the number of perforations designated by said designation device, to make the designated number of perforations at a time through said continuous film;

a cutter for cutting said continuous film into individual filmstrips at a length corresponding to the designated number of perforations;

a transporting device for transporting said continuous film from said die set device toward said cutter by a unit length after each selective actuation of said punch holders, said unit length being determined in accordance with the length of the filmstrip having the designated number of perforations and a cutting blank between said filmstrips in said continuous film; and a film length adjusting device for adjusting the length of said continuous film extending between said die set device and said cutter to said unit length such that said cutter and said at least one of said punch holders are actuated in synchronism with each other while said continuous film stops after each transport by said unit length;

wherein said filmstrips include photographic filmstrips having at least a perforation per frame exposure location;

wherein said film length adjusting device sets the length of said continuous film from a cut position of said cutter to a punching position of said die set device into a value a number M of times as long as said unit length, plus a length from a first end of each of said filmstrips to be cut at said cut position, to a first perforation to be made at said punching position in said each filmstrip;

wherein said film length adjusting device comprises:

first and second pass rollers;

a movable roller disposed between said pass rollers to be movable in a vertical direction;

a guide member for guiding said movable roller in the vertical direction; and an actuation mechanism for moving said movable roller into a position determined based on said unit length;

wherein said actuation mechanism of said film length adjusting device comprises a motor, an encoder for detecting rotational position of said motor, a timing belt for transmitting rotational movement of said motor to said encoder, and a supporting member supporting said movable roller thereon, said supporting member being securely coupled to said timing belt and mounted movable along said guide member when said motor rotates.

* * * * *